US012442273B1

(12) United States Patent
Massey et al.

(10) Patent No.: US 12,442,273 B1
(45) Date of Patent: Oct. 14, 2025

(54) LIMITLESS INJECTION SHOE

(71) Applicant: Weatherford Technology Holdings, LLC., Houston, TX (US)

(72) Inventors: Travis W. Massey, Spring, TX (US); Joshua V. Symms, Cypress, TX (US)

(73) Assignee: Weatherford Technology Holdings, LLC., Houston, TX (US)

( * ) Notice: Subject to any disclaimer, the term of this patent is extended or adjusted under 35 U.S.C. 154(b) by 0 days.

(21) Appl. No.: 18/810,298

(22) Filed: Aug. 20, 2024

Related U.S. Application Data

(60) Provisional application No. 63/684,802, filed on Aug. 19, 2024.

(51) Int. Cl.
*E21B 33/14* (2006.01)
*E21B 17/14* (2006.01)
*E21B 33/04* (2006.01)

(52) U.S. Cl.
CPC ..... *E21B 33/14* (2013.01); *E21B 17/14* (2013.01); *E21B 33/04* (2013.01)

(58) Field of Classification Search
CPC ..... E21B 33/14; E21B 33/146; E21B 33/16; E21B 34/142; E21B 33/165
See application file for complete search history.

(56) References Cited

U.S. PATENT DOCUMENTS 2,925,865 A * 2/1960 Oliver ..... E21B 33/16 166/117
3,948,322 A 4/1976 Baker
5,279,370 A * 1/1994 Brandell ..... E21B 34/14 166/184
5,829,523 A 11/1998 North
5,829,526 A * 11/1998 Rogers ..... E21B 23/04 166/291
8,720,561 B2 * 5/2014 Zhou ..... E21B 33/146 166/194
9,297,230 B2 * 3/2016 Stair ..... E21B 33/12
2008/0251253 A1 * 10/2008 Lumbye ..... E21B 33/165 166/317

(Continued)

OTHER PUBLICATIONS

International Search Report and Written Opinion issued Jun. 4, 2025, in International Patent Application No. PCT/US2025/021605, 14 pages.

*Primary Examiner* — Kipp C Wallace
(74) *Attorney, Agent, or Firm* — Vorys, Sater, Seymour and Pease LLP

(57) ABSTRACT

A method for cementing a casing string allows for a deactivation fluid to be injected into a toe of a wellbore in sufficient quantities without displacing cement accumulated in an annulus around the casing string. The method includes landing a first isolation device within a flow path to isolate a shoe track from an annular isolation apparatus and a communication tool. A seal member of the annular isolation apparatus is radially extended around the casing string to fluidly isolate an annulus above the seal member from a toe of the wellbore. A cement slurry is pumped through at least one radial port into the annulus above the seal member without passing through the shoe track. The deactivation fluid is pumped through a bypass mechanism of the first isolation device and into the shoe track while the toe of the wellbore is fluidly isolated from the annulus above the seal member.

9 Claims, 5 Drawing Sheets

(56) References Cited

U.S. PATENT DOCUMENTS

| | | | | |
|---|---|---|---|---|
| 2015/0184489 | A1 | 7/2015 | Resweber | |
| 2016/0024877 | A1* | 1/2016 | Coronado | E21B 34/10 166/177.4 |
| 2017/0306719 | A1* | 10/2017 | Jerez | E21B 33/127 |
| 2022/0228461 | A1* | 7/2022 | Sims | E21B 34/063 |
| 2023/0265735 | A1 | 8/2023 | Wright et al. | |
| 2025/0215766 | A1* | 7/2025 | Al-Ahmad | E21B 21/10 |

* cited by examiner

LIMITLESS INJECTION SHOE

FIELD OF THE DISCLOSURE

The present disclosure relates generally to wellbore construction, and more particularly to systems and methods for cementing a casing string into a wellbore in preparation for extracting hydrocarbons or other resources from a geologic formation surrounding the wellbore.

BACKGROUND OF THE DISCLOSURE

Wellbores may be drilled to recover natural deposits of oil and gas, as well as other desirable materials that are trapped in subterranean geological formations. After the wellbore is drilled to a terminal depth, a relatively large diameter pipe referred to as "casing" may be installed and cemented in place within the wellbore. The cement is often installed by pumping a predetermined volume of cement slurry through an inner flow passageway through the casing using high-pressure pumps. The cement slurry is pumped through the casing, out a downhole end of the casing, and back up through an annulus defined between the outer circumference of the casing and the wellbore wall. After the predetermined volume of cement slurry is pumped, a plug or wiper assembly may be pumped down the inner flow passageway of the casing to displace the cement slurry from the inner flow passageway. In this manner, the cement slurry leaves the inner bore of the casing and enters the annulus around the casing. As it cures and hardens, the cement secures the casing in place and forms a seal to prevent fluid flow along the outer surface of the casing.

Often the plug or wiper assembly is pumped through the casing with a predetermined volume of spacer or "deactivation" fluid and landed into a profile in a shoe track located at the lowermost section of the casing. Once landed, a rupture disk or valve on the plug or wiper assembly may be opened to permit passage of the deactivation fluid through the plug or wiper assembly to clean the shoe track and prevent any cement remaining in the shoe track from curing. The deactivation fluid may then be expelled from the shoe track and mixed with other fluids in a toe of the wellbore to prepare the toe for hydraulic fracturing or other injection operations.

If the volume of deactivation fluid is too small, the shoe track and other equipment may be insufficiently cleaned, which could lead to debris pack-off, valve erosion, fouled valves, etc., which may frustrate the toe preparation or any subsequent operations in the wellbore. If the volume of deactivation fluid is too great, the excess deactivation fluid may enter the annulus around the casing string, displacing the cement in the anulus and/or preventing the cement in the annulus from curing.

The production of hydrocarbons may be frustrated through the portions of the wellbore where the cement in the annulus remains uncured. In some instances, about 5 barrels of deactivation fluid may reach the annulus, which may frustrate production through 500 feet of the wellbore. Thus, methods and devices for cementing a casing string in a wellbore that do not rely on estimating the proper amount of deactivation fluid may facilitate injection operations and ensure effectively curing the cement in the annulus.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method for cementing a casing string in a wellbore includes deploying the casing string into the wellbore. The casing string provides a flow path and includes a shoe track at a lower end of the casing string, an annular isolation apparatus arranged uphole from the shoe track and including a seal member, and a communication tool arranged uphole from the annular isolation apparatus. The method further includes landing a first isolation device within the casing string and thereby forming a seal within the flow path below the annular isolation apparatus and isolating the shoe track from the annular isolation apparatus and the communication tool. The method also includes radially expanding the seal member and thereby forming a seal within an annulus defined between the casing string an inner wall of the wellbore, and thereby fluidly isolating the annulus above the seal member from a toe of the wellbore. The method includes opening at least one radial port defined in the communication tool to establish fluid communication between the flow path above the first isolation device and the annulus above the seal member, circulating a cement slurry through the flow path and the at least one radial port to be received within the annulus above the seal member, activating a bypass mechanism of the first isolation device to permit flow through the first isolation device and pumping a deactivation fluid through the bypass mechanism to the shoe track and through an opening in the shoe track to be received within the toe of the wellbore while the toe of the wellbore is fluidly isolated from the annulus above the seal member.

According to another embodiment consistent with the present disclosure, a casing string assembly for deployment in a wellbore includes a shoe track provided at a lower end of a casing string that provides a flow path, an annular isolation apparatus arranged uphole from the shoe track and including a radial sealing member operable to expand radially and form a seal within an annulus defined between the casing string and an inner wall of the wellbore, a communication tool arranged uphole from the annular isolation apparatus and including at least one port that facilitates fluid communication between the flow path and the annulus, the at least one port being selectively opened and closed to permit and restrict fluid flow therethrough, and a first isolation device operable to form a seal within the flow path downhole from the annular isolation apparatus and thereby isolating the shoe track from the annular isolation apparatus and the communication tool, the first isolation device including a bypass mechanism selectively operable to permit fluid flow through the first isolation device.

According to still another embodiment consistent with aspects of the present disclosure, a wellbore system includes a casing string defining a flow path therethrough and extending into a wellbore to define an annulus between the casing string and a geologic formation. The casing string includes a shoe track provided at a lower end of the casing string, an annular isolation apparatus arranged uphole from the shoe track and including a radial sealing member operable to expand radially and form a seal within the annulus, and a communication tool arranged uphole from the annular isolation apparatus and including at least one port that facilitates fluid communication between the flow path and the annulus, the at least one port being selectively opened and closed to permit and restrict fluid flow therethrough. The wellbore system further includes a first isolation device operable to form a seal within the flow path downhole from the annular isolation apparatus and thereby isolating the shoe track from the annular isolation apparatus and the communication tool, the first isolation device including a bypass mechanism selectively operable to permit fluid flow through the first isolation device, a pump in fluid communication with the flow path, and a fluid source fluidly coupled to the pump, the fluid source including at least a cement slurry and a deactivation fluid.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
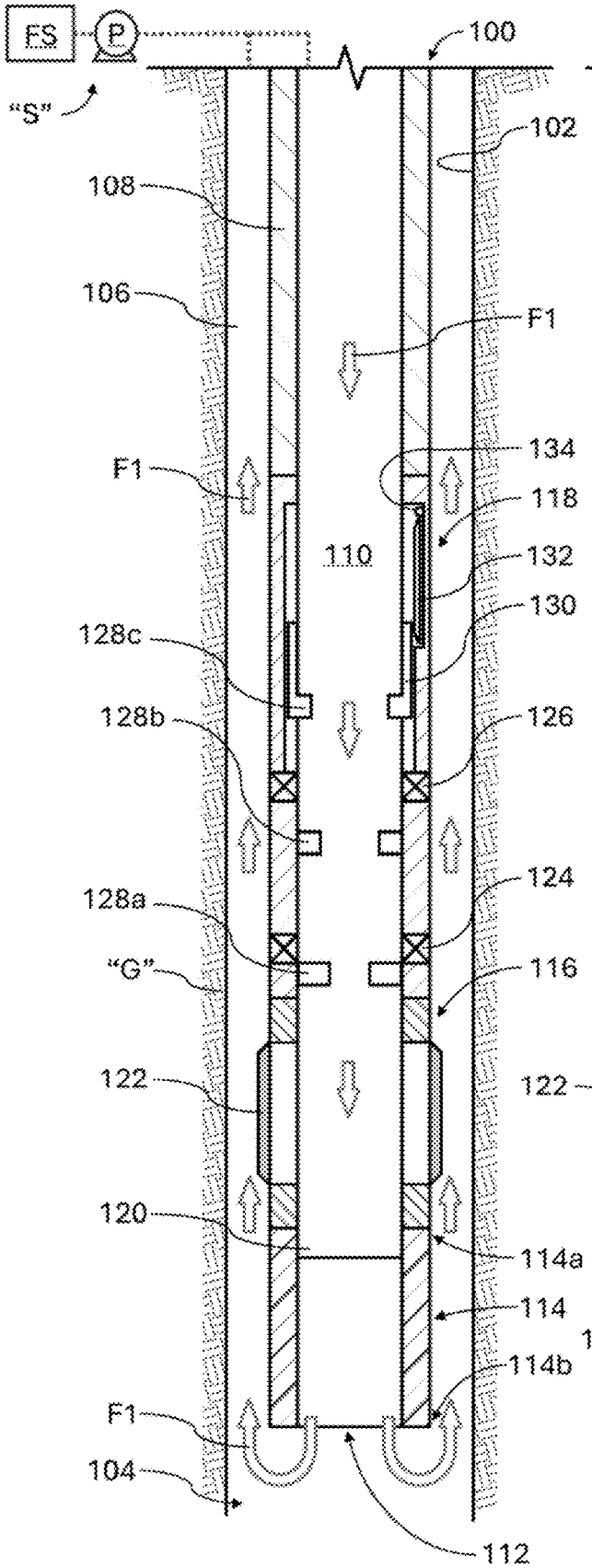
FIG. 1 is a partial cross-sectional view of casing string deployed in a wellbore, the casing string including a shoe track, an annular isolation apparatus and a communication tool in an initial configuration in accordance with aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a casing string including a shoe track at a lowermost end thereof, an annular isolation apparatus coupled above the shoe track and a communication tool coupled above the annular isolation apparatus. The annular isolation apparatus may be activated to form a seal around the casing string in a wellbore, and the communication tool may be activated to permit fluid communication between an interior of the casing string and an exterior annulus around the casing string and above the annular isolation apparatus. A cement slurry may be pumped into the annulus through communication tool to secure the casing string in place. A deactivation fluid may then be pumped through the interior of the casing string into a toe of the wellbore. At least because the annular isolation apparatus isolates the cement slurry from the deactivation fluid, an unlimited amount of deactivation fluid may be pumped into the toe of the wellbore without displacing the cement in the anulus.

FIG. 1 is a partial cross-sectional view of an example casing string 100 deployed in a wellbore 102, and in accordance with the principles of the present disclosure. As illustrated, the wellbore 102 extends through a geologic formation "G" in a substantially vertical direction. In other embodiments, aspects of the disclosure may practiced in a wide variety of vertical, directional, deviated, slanted and/or horizontal wellbore portions without departing from the scope of the disclosure. The casing string 100 extends to a toe 104 generally located or defined at a lower or downhole end of the wellbore 102. An annulus 106 is defined between the outer circumference of the casing string 100 and the inner wall of the wellbore 102. The casing string 100 may be constructed of a plurality of casing sections 108 coupled to one another in an end-to-end arrangement (e.g., a threaded engagement). An interior flow path 110 extends through the casing string 100 to an opening 112 defined (provided) at a lowermost end (i.e., downhole end) of the casing string 100.

The casing string 100 generally includes a shoe track 114 at the lowermost end, an annular isolation apparatus 116 coupled (arranged) above the shoe track 114 and a communication tool 118 coupled (arranged) above the annular isolation apparatus 116. The shoe track 114, annular isolation apparatus 116 and communication tool 118 are each supported on individual, adjacent sections 108 of the casing string 100, but in other embodiments, one more of the shoe track 114, isolation apparatus 106 and the communication tool 118 may be combined on a single section 108 of casing or separated from one another by additional casing sections (not shown), without departing from the scope of the disclosure.

The shoe track 114 may be provided as the lowest or one of the lowermost casing sections 108 in the casing string 100 (i.e., the furthest downhole). As illustrated, the shoe track 114 includes a landing profile 120 at an upper end 114*a* thereof in which an isolation device 202 (FIG. 2) or other equipment may be received and installed. In some embodiments the landing profile 120 may include an upward facing shoulder or latch constructed of steel, plastic, cement or other drillable (millable) materials. Although the landing profile 120 is illustrated as a feature of a particular casing section 108, in other embodiments, the landing profile 120 may be defined on a landing collar, a float collar or other component coupled within the casing string 100 at the upper end 114*a* of the shoe track 114. A lower end 114*b* of the shoe track 114 defines the opening 112 through which fluids may exit and enter the interior flow path 110. In some embodiments, the lower end 114*b* may support a rounded guide shoe or float shoe (not shown) thereon, which may facilitate deploying the casing string 100 into the wellbore 102.

The annular isolation apparatus 116 is coupled (arranged) above (i.e., uphole from) the shoe track 114. The annular isolation apparatus 116 generally includes a radial sealing element 122 that is selectively operable (actuatable) to expand radially outward and form an annular seal within the annulus 106 and around the casing string 100. As described in greater detail below, the radial sealing element 122 may be constructed as an elastomeric packer that is inflatable or radially extendable in response to increased pressures within the interior flow path 110. In other embodiments, the radial sealing element 122 may be constructed of a swellable material that is responsive to exposure to a particular wellbore fluid or a compressible material that is responsive to a longitudinal force to radially extend the radial sealing element 122. In still other embodiments, the radial sealing element 122 may include mechanical-set elements, which may be extended radially outward in response to mechanical movements of a tool string and/or a setting tool, weight-set elements, which may be extended radially outward in response to a weight of a fluid or device applied thereto, compression elements that expand radially when longitudinally compressed, wireline set elements or other expandable elements without departing from the scope of the disclosure. The radial extension may cause radial sealing element 122 to engage the geologic formation "G" and form an annular seal around the casing string 100.

The communication tool 118 is coupled (arranged) in the casing string 100 above the annular isolation apparatus 116. The communication tool 118 includes at least one first port 124 and at least one second port 126 longitudinally spaced from one another. As illustrated in FIG. 1, a pair of first ports 124 are provided and a pair of second ports 126 are provided, but any number of first and second ports 124, 136 may be provided without departing from the scope of the disclosure. The first and second ports 124, 126 extend laterally between the internal flow path 110 and the annulus 106 and may be selectively opened and closed to permit and restrict fluid flow therethrough. The first and second ports 124, 126 are shown in FIG. 1 in a closed configuration, wherein fluid flow through the ports 124, 126 is prohibited. The first port(s) 124 may be opened and closed independently of whether the second port(s) 126 is/are opened or closed.

In some embodiments, a sliding sleeve (not shown) or other closure member may be provided within the annulus 106 and/or the internal flow path 110 to open and close the first and second ports 124, 126. For example, the sliding sleeve may be moved longitudinally in response to changes in pressure or activated by a downhole actuator (not shown) in response to a signal from an operator at a surface location. The actuator may be hydraulic, pressure activated, mechanical, electro-mechanical, pressure pulse (e.g., mud pulse), delayed opening with flow/pressure or any other type of actuator recognized in the art.

An interior of the communication tool 118 includes a plurality of longitudinally spaced landing profiles 128*a*, 128*b*, 128*c*, referred to herein collectively as "landing profiles 128". Similar to the landing profile 120 in the shoe track 114, the landing profiles 128 may include an upward facing shoulder or latch for supporting a corresponding isolation device 402 (FIG. 4), 702 (FIG. 7) or other equipment thereon. Each landing profile 128 may be uniquely shaped to receive a correspondingly shaped device thereon.

The first and second landing profiles 128*a* and 128*b* are disposed (provided) at longitudinally fixed positions within the communication tool 118, while the third landing profile 128*c* is disposed (provided) on a sliding sleeve 130. The sliding sleeve 130 is illustrated in an initial longitudinal position wherein the sliding sleeve 130 longitudinally (axially) overlaps a barrier member 132. In the initial position, the sliding sleeve 130 may be positioned such that it retains the barrier member 132 in a retracted position with respect to the flow path 110. As described in greater detail below, the sliding sleeve 130 may be moved longitudinally downward (see FIG. 7) to an activated longitudinal position in response to landing the isolation device 702 thereon. Moving the sliding sleeve 130 downhole (downward) may permit movement of the barrier member 132 to an extended position wherein the barrier member 132 extends across the flow path 110. In some embodiments, the barrier member 132 is constructed as a flapper biased to the extended position by a spring 134 or another biasing member. It should be appreciated that other types of barrier members may be substituted for barrier member 132 without departing from the scope of the disclosure. For example, safety valves, propped valves or other types of valves that are initially propped or restrained, and then unpropped or released to close the flow path 110, may be substituted.

A pump "P" and a fluid source "FS" may be disposed at a surface location "S" outside the wellbore 102. The fluid source "FS" may include a supply of conditioning fluid F1 and any of the other fluids described herein, e.g., fluids F0 through F7 described below. The pump "P" and the fluid source "FS" may be fluidly coupled to both the flow path 110 extending through the casing 100 and the annulus 106 around the casing string 100 such that the pump "P" may deliver the fluids F0 through F6 to the wellbore 102 at any predetermined pressure as described hereinbelow.

A procedure for cementing the casing string 100 is now described below with reference to FIGS. 1-8. The procedure allows for a sufficient volume of a deactivation fluid F0 (FIG. 8) to be pumped into the wellbore 102 to ensure a clean shoe track 114 while avoiding a risk that the deactivation fluid F0 will improperly enter the annulus 106.

Initially, as illustrated in FIG. 1, the casing string 100 is deployed into the wellbore 102 in an initial configuration where the flow path 110 is unobstructed. The conditioning fluid F1 may be circulated through the flow path 110 and then exit the casing string 100 through the opening 112 into the toe 104 of the wellbore 102. The conditioning fluid F1 may include a variety of fluids such as, but not limited to, liquids, gasses, gels, aerosols, water, drilling muds, cement, cement inhibitors, retardant fluids, organic acids, biocides, frac fluids etc., to clean out the toe 104 by removing any debris or formation damage, for example. In some embodiments, a portion of the conditioning fluid F1 may be received within the geologic formation "G" to prepare the geologic formation "G" for hydraulic fracturing or other planned wellbore operations. The conditioning fluid F1 may flow into the annulus 106 and return to the surface location "S" through the annulus 106. In various embodiments, the conditioning fluid F1 and any of the other fluids described below, e.g., fluids F0 through F7 may be the same or different from the other fluids F0 through F7 described below.

Figure 2:
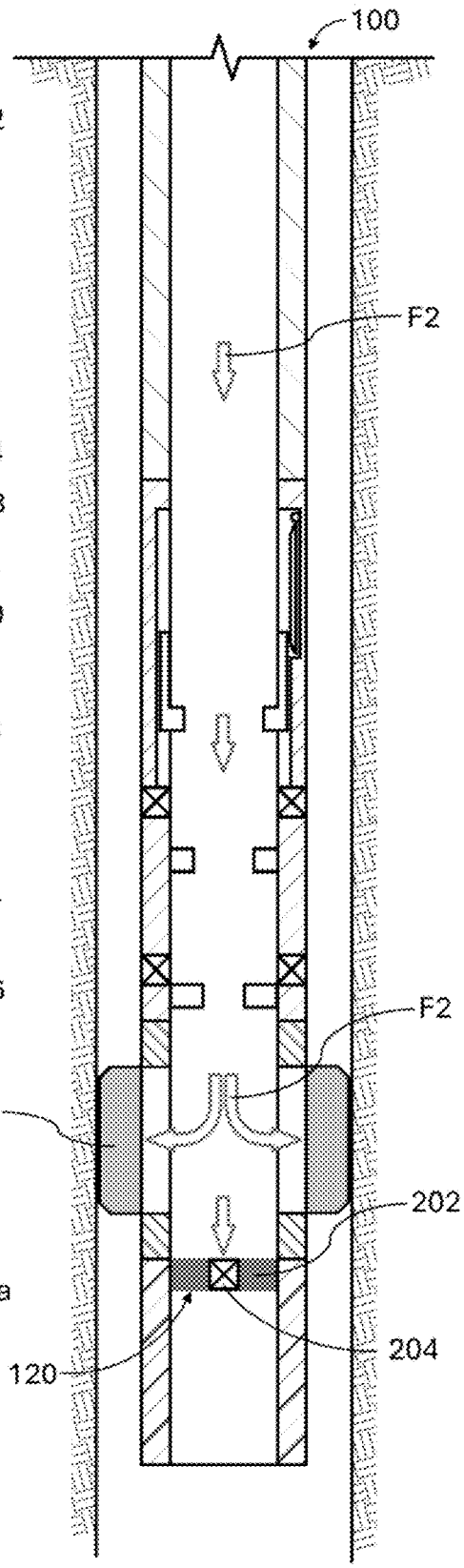
FIG. 2 is a partial cross-sectional view of the casing string in a second configuration in which a first isolation device is installed within the shoe track and the annular isolation apparatus is activated.

Referring now to FIG. 2, the casing string 100 is illustrated in a second configuration in which a first isolation device 202 has been conveyed downhole and landed on the landing profile 120. The first isolation device 202 may comprise a dart, ball, plug or other wellbore isolation device operable to create a seal with the landing profile 120 so that pressure may be increased above (uphole from) the first isolation device 202. The first isolation device may be sized such that it is able to be pumped (conveyed) through the landing profiles 128 to locate and be received by the landing profile 120. More specifically, the first isolation device 202 may be sized and/or shaped to pass through the landing profiles 128, and in some embodiments may expand upon reaching the landing profile 120 to form a seal therewith.

With the first isolation device 202 seated and sealed with the landing profile 120, a fluid pressure above (uphole from) the first isolation device 202 may be increased to radially expand the radial sealing element 122. To accomplish this, an inflation fluid F2 may be pumped into the casing string 100 to apply a hydraulic load against the first isolation device 202, and a resulting increase in pressure in the flow path 110 may activate the radial sealing element 122 until the radial sealing element 122 forms a seal with the geologic formation "G" or another surrounding structure. In some embodiments, the inflation fluid F2 may be the same fluid as the conditioning fluid F1 (FIG. 1), and in other embodiments the conditioning fluid F1 and the inflation fluid F2 may be different. As described above, the radial sealing element 122 may be set by various other mechanisms in other embodiments.

The first isolation device 202 includes a bypass mechanism 204, which may be selectively activated or opened (see FIG. 8) to permit fluid flow through the isolation device 202. In some embodiments, the bypass mechanism 204 (and any of the other bypass mechanisms described herein) may include a rupture disk, a frangible disk constructed of glass, composite, etc., a flow valve, a remotely activated valve or other mechanism recognized in the art.

Figure 3:
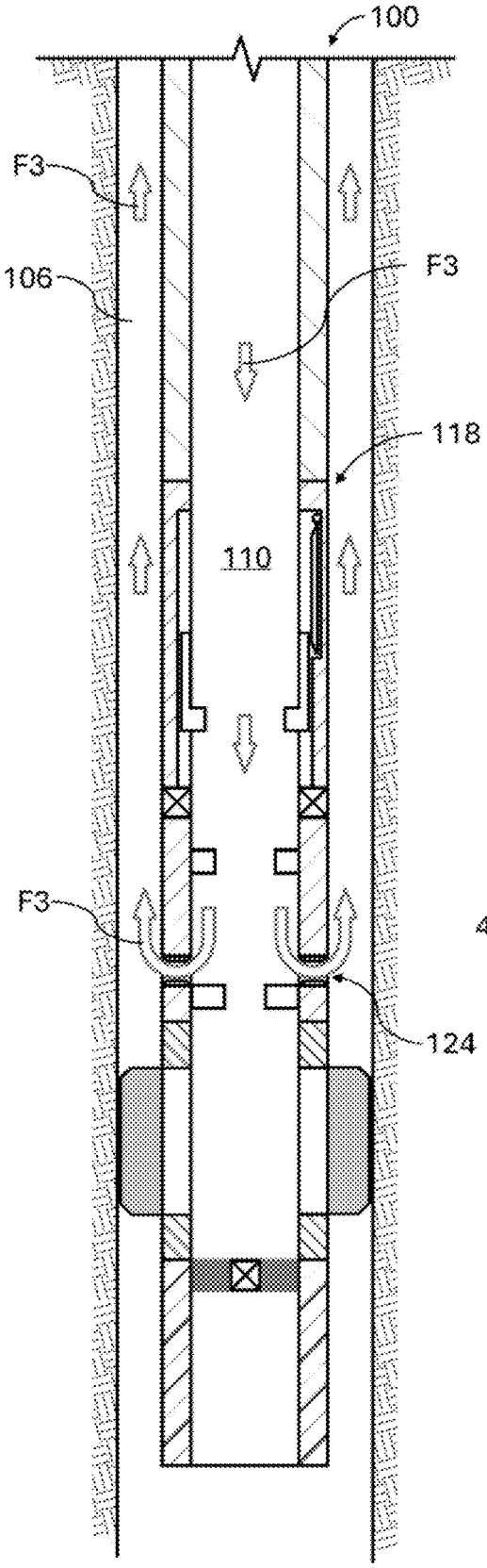
FIG. 3 is a partial cross-sectional view the casing string in a third configuration in which a first port on the communication tool is opened to permit circulation of fluid between an interior of the casing string and an external annulus above the annular isolation apparatus.

Referring now to FIG. 3, the casing string 100 is illustrated in a third configuration wherein the at least one first port 124 of the communication tool 118 is opened. In some embodiments, the first port 124 may be opened by pumping a circulation fluid F3 down flow path 110 at a predetermined pressure, and the increased pressure may shift a sliding sleeve or other mechanism to open the first port 124 as described above. The sliding sleeve or other mechanism may be activated by various systems as described above. In some embodiments, the opening of the first port 124 may be tied to the setting of the radial sealing element 122. For example, the first port 124 may be opened after a predetermined time has elapsed after the radial sealing element 122 is expanded. The circulation fluid F3 may then pass through the opened first port 124 and into the annulus 106, where it may return to the surface through the annulus 106 and provide an indication to an operator that proper circulation has been established. For example, a predetermined volume of the circulation fluid F3 may be pumped down the flow path 110, and the volume of circulation fluid F3 returned to the surface location "S" (FIG. 1) may be recorded. If the volume recorded matches the predetermined volume, the operator may determine that the circulation fluid F3 is circulating properly and not being lost to the geologic formation "G."

Figure 4:
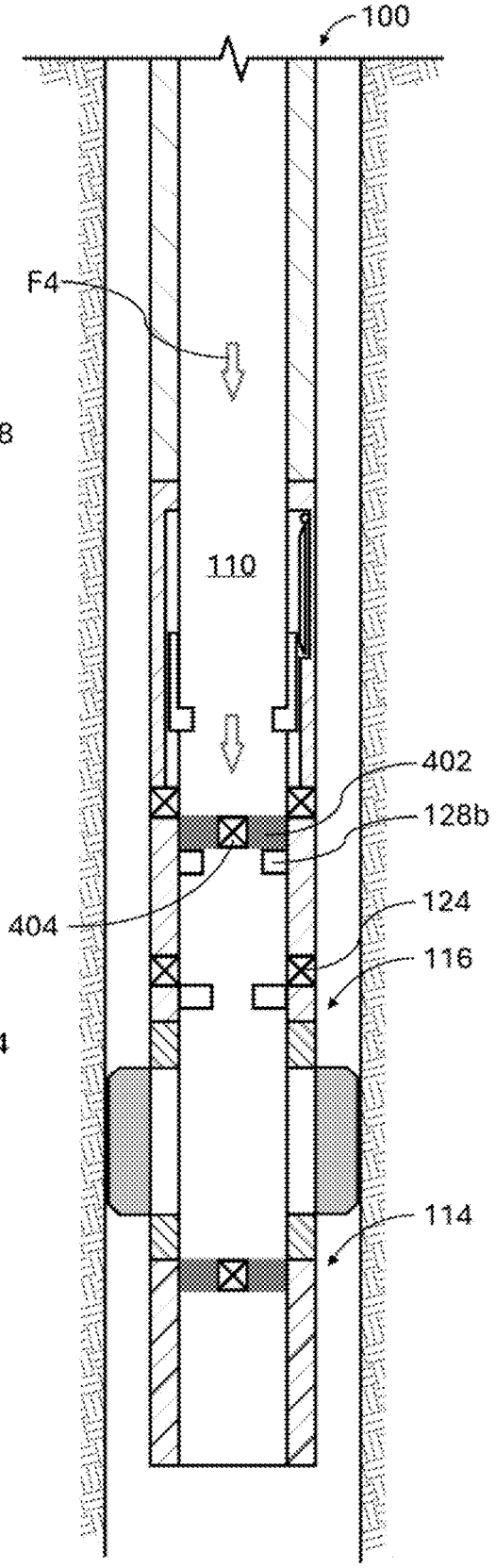
FIG. 4 is a partial cross-sectional view the casing string in a fourth configuration in which a first a second isolation device is installed within the communication tool.

Referring now to FIG. 4, the casing string 100 is illustrated in a fourth configuration in which a second isolation device 402 has been introduced downhole and landed on the landing profile 128*b*. The second isolation device 402 may be pumped downhole through the flow path 110 with a proving fluid F4 and form a seal with the landing profile 128*b* above the first port 124. In some embodiments, landing the second isolation device 402 on the landing profile 128*b* is associated with a reduction of pressure at the first port 124, which causes the first port 124 to close. In other embodiments, an operator may actively transmit a command signal to the first port 124 to cause the first port 124 to close. With the first port 124 closed and the second isolation device 402 sealed with the landing profile 128*b*, the proving fluid F4 will not recirculate to the surface location (FIG. 1). Rather, the proving fluid F4 may be pumped until reaching a predetermined pressure to verify that the proving fluid F4 is isolated above the shoe track 114 and the annular isolation apparatus 116. The second isolation device 402 includes a bypass mechanism 404, which may be activated to permit fluid flow through the second isolation device 402, as described in greater detail below.

Figure 5:
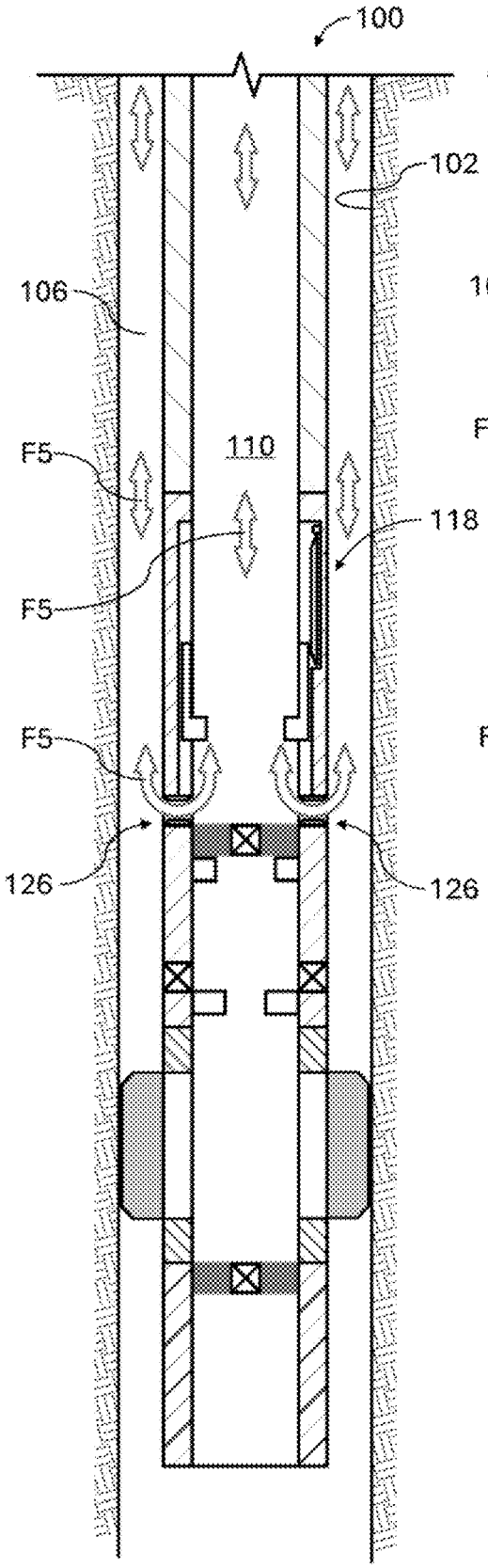
FIG. 5 is a partial cross-sectional view the casing string in a fifth configuration in which a second port on the communication tool is opened to permit bi-directional circulation of fluid between the interior of the casing and the annulus.

Referring now to FIG. 5, the casing string 100 is illustrated in a fifth configuration in which the at least one second port 126 of the communication tool 118 is opened. Similar to the first port(s) 124, the second port(s) 126 may be opened by pumping a secondary circulation fluid F5 to a predetermined pressure within the flow path 110 and/or by sending a command signal from the surface location "S," for example. With the second port 126 opened, the secondary circulation fluid F5 may be circulated through the wellbore 102. For example, the secondary circulation fluid F5 may be pumped into the flow path 110 and returned to the surface location "S" (FIG. 1) through the annulus 106. In this way, obstructions may be cleared from the wellbore or other issues may be resolved by circulating the secondary circulation fluid F5.

In some embodiments, the secondary circulation fluid F5 may alternatively or additionally be circulated in an opposite direction. For example, the secondary circulation fluid F5 may be pumped into the annulus 106 and returned to the surface location "S" through the flow path 110. In this manner, the secondary circulation fluid F5 may be bidirectionally circulated through the wellbore. In some embodiments, the secondary circulation fluid F5 may be the same fluid as the providing fluid F4 described above. In other embodiments, secondary circulation fluid F5 and the providing fluid F4 may be different.

Figure 6:
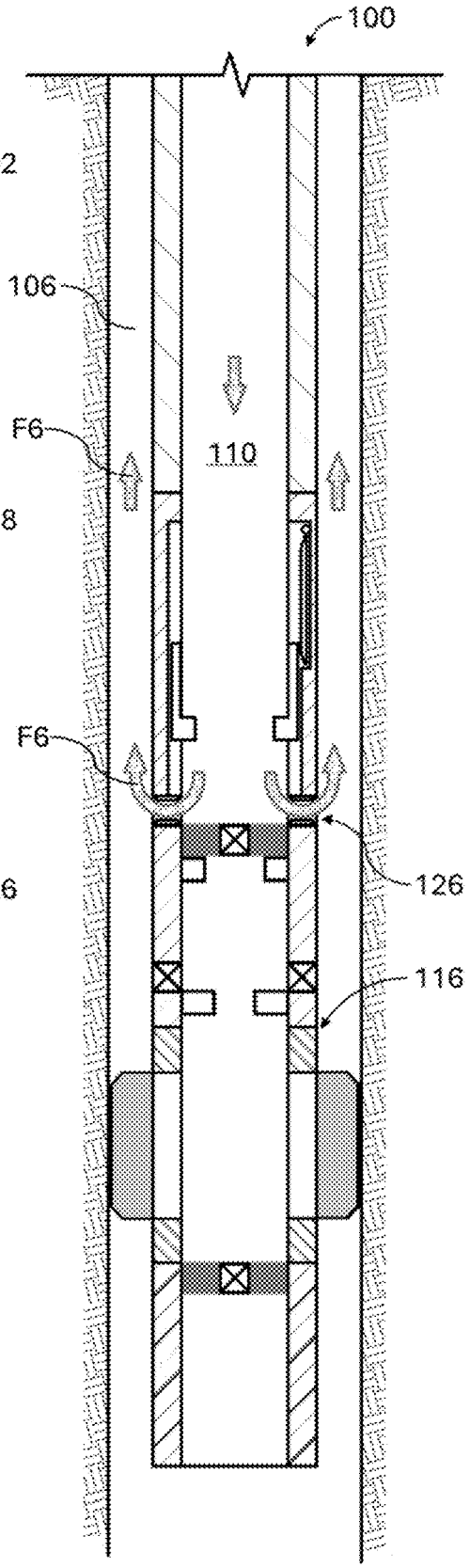
FIG. 6 is a partial cross-sectional view the casing string in a sixth configuration in which a cement slurry may be pumped through the second port into the annulus above the annular isolation apparatus.

Referring now to FIG. 6, the casing string 100 is illustrated in a sixth configuration in which a cement slurry F6 may be pumped through the flow path 110, out the second port(s) 126 and into the annulus 106 above (uphole from) the annular isolation apparatus 116. The cement slurry F6 may thereby be delivered to the annulus 106 without pumping the cement slurry F6 through the shoe track 114 and without damaging any of the sensitive float equipment that may be carried by the shoe track 114. The cement slurry F6 may continue being pumped until the annulus 106 above the annular isolation apparatus 116 is filled. The cement slurry 106 may include traditional cement in some embodiments, and in other embodiments may include other annulus sealing fluids such as foams, bismuths, epoxy or other settable fluids without departing from the scope of the disclosure.

Figure 7:
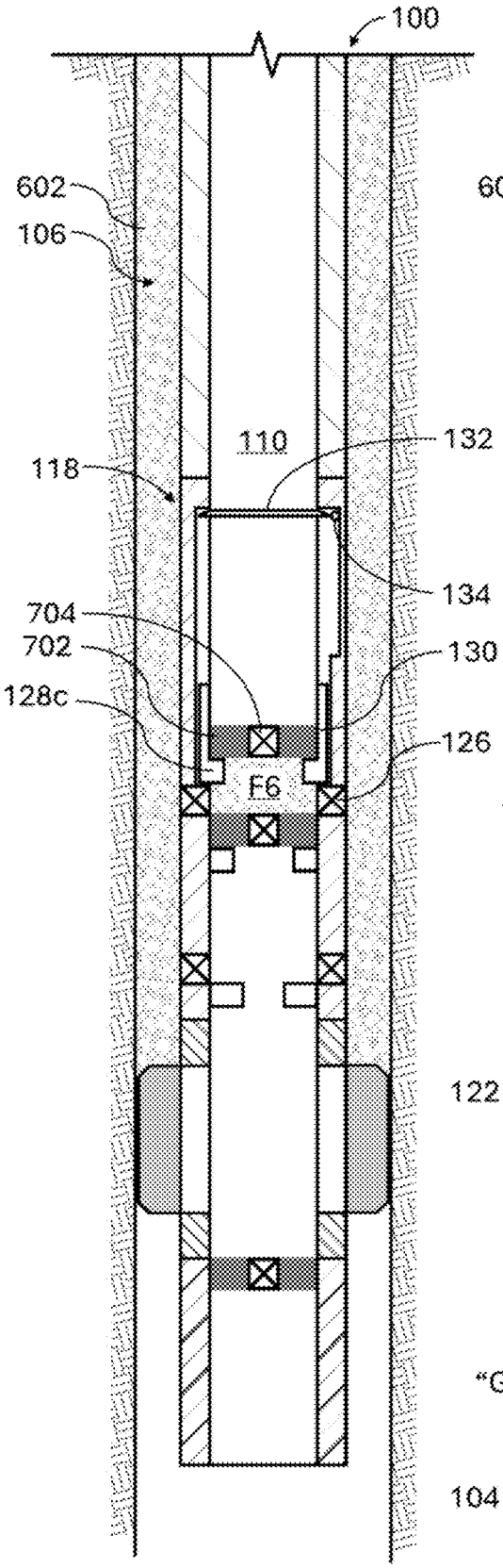
FIG. 7 is a partial cross-sectional view the casing string in a seventh configuration in which the annulus above the annular isolation apparatus is filled with cement and a third isolation device is installed within the casing above the second isolation device.

Referring now to FIG. 7, the casing string 100 is illustrated in a seventh configuration in which accumulation 602 of cement has filled the annulus 106. The accumulation 602 may be established as the cement slurry F6 fills the annulus 106 begins to cure and harden. As illustrated in FIG. 7, the cement slurry F6 is also present in flow path 110 above the second isolation device 402. In some other embodiments, a displacement fluid (not shown) may be pumped into the flow path 110 behind the cement slurry F6 to displace the cement slurry F6 into the annulus 106 such that no cement slurry F6 remains within the flow path 110.

A third isolation device 702 has been pumped against the landing profile 128*c* and formed a seal therewith across the flow path 110. In some embodiments, the third isolation device 702 may be pumped against the landing profile 128*c* with a spacer fluid (not shown) above and/or below the third isolation device 702. As the third isolation device 702 is pumped down, the cement slurry F6 is forced out through the second port(s) 126 until the third isolation device 702 lands at the landing profile 128*c*. The third isolation device 702 prevents flow through the flow path 110 downhole and past the landing profile 128*c*. The third isolation device 702 also includes a bypass mechanism 704, which may be selectively activated or opened (see FIG. 8) to permit fluid flow through the third isolation device 702, as described in greater detail below. The second port(s) 126 is returned to a closed configuration by landing the third isolation device 702 on the landing profile 128*c* or by a control signal sent from the surface location "S" or from another downhole device, for example. In some embodiments, the second port 126 may be closed in response to a signal received from the third isolation device 702, sliding sleeve 130 or other component confirming that the third isolation device 702 has properly landed.

Landing the third isolation device 702 on the landing profile 128*c* may also shift the sliding sleeve 130 longitudinally downward from the initial position (FIG. 1) to the activated position illustrated in FIG. 7. For example, a fluid pressure applied by the pump "P" (FIG. 1) may act on the third isolation device 702, which in turn applies a downward longitudinal force on the sliding sleeve 130. The downward longitudinal force may, in some embodiments, shear a shear pin or other coupling (not shown) operable to shear or release at a predetermined force extending between the sliding sleeve 103 and the casing string 100 allowing the sliding sleeve to move longitudinally downward to the activated position. In the activated position, the sliding sleeve 130 does not longitudinally overlap the barrier member 132, and thus, the barrier member 132 may be moved to the extended (deployed) position across the flow path 110 under the influence of the spring 134. In other embodiments, the landing profile 128*c* may be stationary within the casing string 100, and the barrier member 132 may be released to move to the extended position by an actuator (not shown) responsive to a control signal transmitted from the surface location "S" (FIG. 1).

In the seventh configuration, pressure may be bled from the casing string 100, and the pressure may be monitored to confirm that the communication tool 118 is fully closed and maintaining pressure integrity. For example, once the pressure is bled effectively from above the barrier member 132, any fluid flow detected at the surface location could be an indication of a leak in the communication tool 118.

Figure 8:
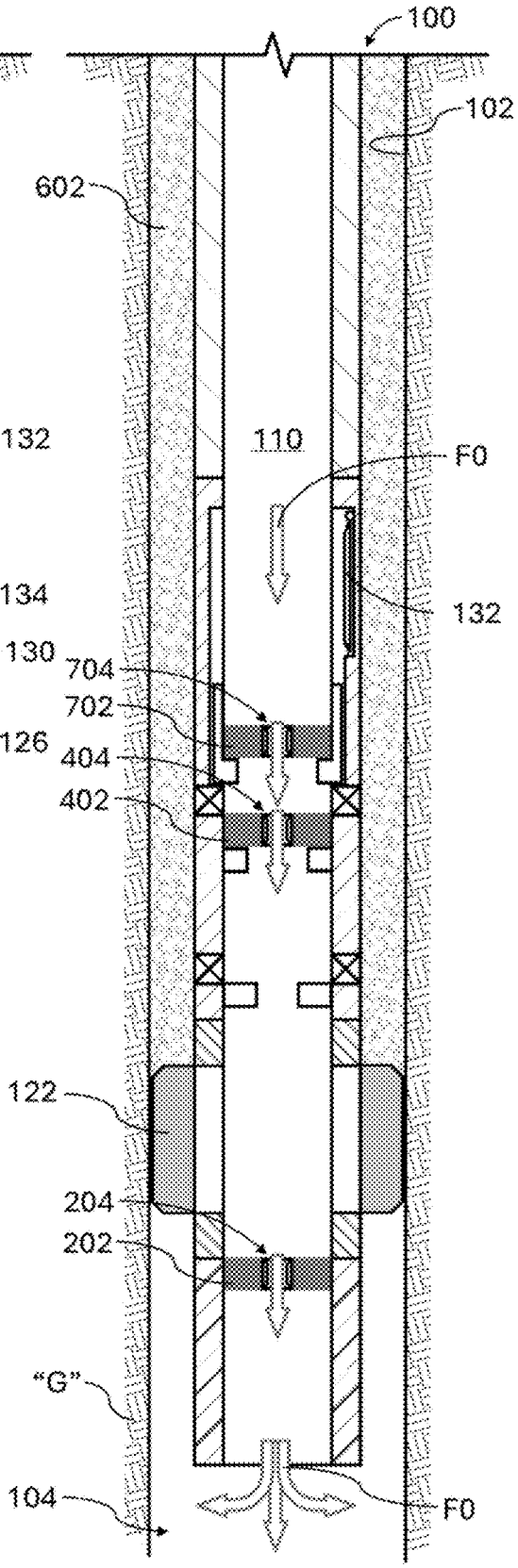
FIG. 8 is a partial cross-sectional view the casing string in an eighth configuration in which a bypass system on each of the first, second and third isolation devices is opened to permit passage of a deactivation through the casing string into a toe of the wellbore.

Referring now to FIG. 8, the casing string 100 is illustrated in an eighth configuration in which the bypass systems 204, 404, 704 on each of the first, second and third isolation devices 202, 402, 702 is opened to permit passage of the deactivation fluid F0 through the casing string 100 into the toe 104 of the wellbore 102. The deactivation fluid F0 may be pumped into the flow path 110 at a predetermined pressure sufficient to move the barrier member 132 to the initial position and to activate each of the bypass mechanisms 704, 404, 204 sequentially. In embodiments where the bypass mechanisms 704, 404, 204 comprise rupture disks, the predetermined pressure of the deactivation fluid F0 may be sufficient to rupture the rupture disks.

The deactivation fluid F0 may be pumped into the toe 104 of the wellbore 102 in sufficient quantities to ensure that none of the cement slurry F6 (FIG. 7) remains in the casing string 110. The deactivation fluid F0 may include fluids such as water, cement inhibitors, retardant fluids, organic acids, biocides and any other types of deactivation fluids recognized in the art. The radial sealing element 122 ensures that the deactivation fluid F0 will not displace the accumulation 602 of the cement up the annulus 106, and thus, the amount of deactivation fluid F0 that may be pumped into the toe 104 without displacing the cement in the annulus may be described as "unlimited." For example, the amount of displacement fluid F0 that may be pumped into the toe is limited only by the capacity of the reservoir in the geologic formation "G" and the capacity of the radial sealing element 122 to maintain a seal around the casing string. Once a predetermined volume of deactivation fluid F0 is pumped into the wellbore 102, pressure may be bled off from the casing string 100 and the wellbore 102 may be prepared for subsequent completion operations.

Figure 9:
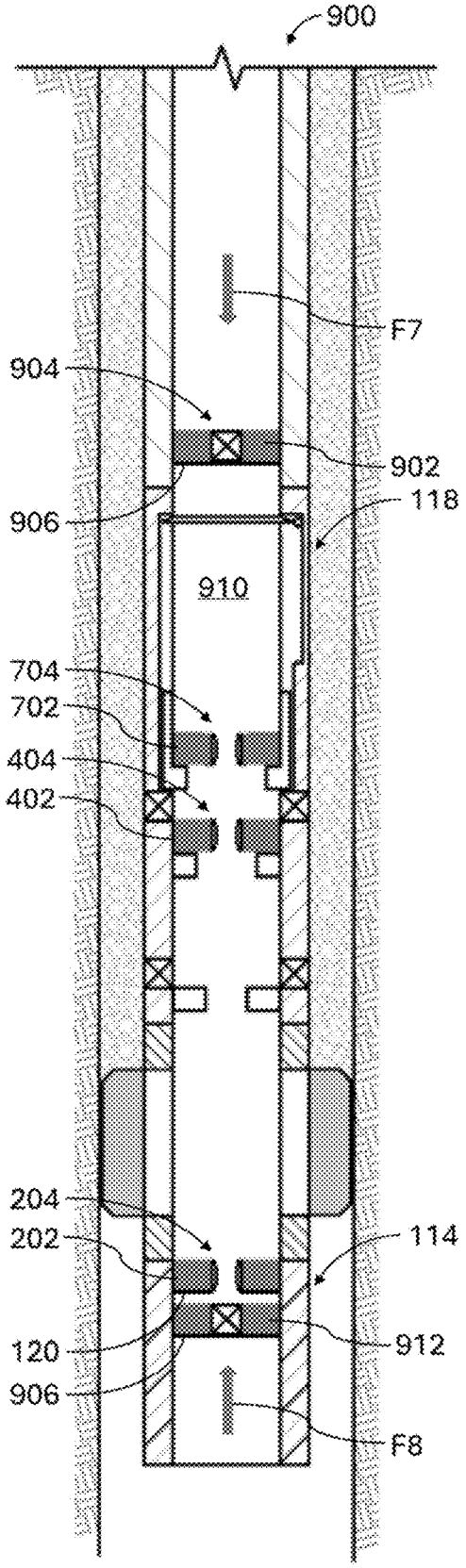
FIG. 9 is a partial cross-sectional view of an alternate embodiment of a casing string in which a fourth isolation device may be installed above the communication tool of FIG. 1 and backpressure barrier may be installed below a landing profile for the first isolation device of FIG. 2.

For example, in some embodiments, as illustrated in FIG. 9, after each of the bypass mechanisms 704, 404, 204 have been opened and the deactivation fluid F0 (FIG. 8) is pumped out through a casing string 900 as described above, a fourth isolation device 902 may be landed above the communication tool 118. The fourth isolation device 902 may include a bypass mechanism 904, which may be selectively actuated to permit fluid flow through the fourth isolation device 902 and may be landed on a corresponding landing profile 906 provided within the casing string 900. Once the fourth isolation device 902 has been landed and forms a seal across the casing string 900, a verification fluid F7 may be pumped against the fourth isolation device 902 and an upper casing barrier (not shown) may be activated, casing to annular and/or annular to casing to provide full isolation for the casing string above the fourth isolation device 902. The upper casing barrier may provide unidirectional (uphole or downhole) sealing in some embodiments. In other embodiments, the upper casing barrier may provide bi-directional or non-direction specific sealing. Pressure may then be applied to the upper casing barrier to verify predetermined specifications have been met. The pressure may then be bled off in sequence-based increments, and then the bypass mechanism 904 may be activated to reestablish fluid flow in a flow path 910 through the casing string 900.

Additionally or alternatively, a lower casing barrier 912 may be landed at a lower landing profile 914 below the landing profile 120 for the first isolation device 202. The lower casing barrier 912 may be landed prior to landing any of the isolation devices 202, 402, 702, or in other embodiments, the lower casing barrier 912 may be run in with the shoe track 114. The lower casing barrier 912 may be maintained in an open position or configuration until the first isolation device 202 is landed, at which time the casing barrier 912 may be moved to a closed position or configuration. In some embodiments, the lower casing barrier 912 is responsive to landing the first isolation device 202 to move from the open position to the closed position. The lower casing barrier 912 may then serve as an independent back pressure barrier to wellbore fluids F8 and thereby to protect the shoe track 114 and any sensitive float equipment carried by the shoe track 114. The fourth isolation device 902 and lower casing barrier 912 are illustrated in FIG. 9 similarly to the isolation devices 202, 402, 702 described above. However, the fourth isolation device 902 and lower casing barrier 912 may include temporary sealing mechanisms or barriers including a valve, safety valve, plunger, etc., without departing from the scope of the disclosure.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The invention claimed is:

1. A method for cementing a casing string in a wellbore, the method comprising:

deploying the casing string into the wellbore, the casing string providing a flow path and including:

a shoe track at a lower end of the casing string;

an annular isolation apparatus arranged uphole from the shoe track and including a seal member; and a communication tool arranged uphole from the annular isolation apparatus;

landing a first isolation device within the casing string and thereby forming a seal within the flow path below the annular isolation apparatus and isolating the shoe track from the annular isolation apparatus and the communication tool;

radially expanding the seal member and thereby forming a seal within an annulus defined between the casing string an inner wall of the wellbore, and thereby fluidly isolating the annulus above the seal member from a toe of the wellbore;

opening at least one radial port defined in the communication tool to establish fluid communication between the flow path above the first isolation device and the annulus above the seal member;

circulating a cement slurry through the flow path and the at least one radial port to be received within the annulus above the seal member;

activating a bypass mechanism of the first isolation device to permit flow through the first isolation device;

pumping a deactivation fluid through the bypass mechanism to the shoe track and through an opening in the shoe track to be received within the toe of the wellbore while the toe of the wellbore is fluidly isolated from the annulus above the seal member;

landing a third isolation device within the casing string at the communication tool; and placing a hydraulic load on the third isolation device and thereby causing a barrier member to transition from a retracted position, where the barrier member does not obstruct the flow path, to an extended position, where the barrier member extends across the flow path.

2. The method of claim 1, wherein circulating the cement slurry through the flow path and the at least one radial port is preceded by:

landing a second isolation device within the casing string at the communication tool; and pumping a circulation fluid into the flow path above the second isolation device and into the annulus above the seal member.

3. The method of claim 2, wherein pumping the circulation fluid includes flowing the circulation fluid downhole through the annulus and uphole through the casing string.

4. The method of claim 2, further comprising:

pumping a proving fluid against the second isolation device; and determining whether the proving fluid recirculates to a surface location to verify that the proving fluid is isolated above the shoe track.

5. The method of claim 1, wherein the third isolation device locates and lands on a sliding sleeve arranged within the casing string at the communication tool, the method further comprising:

maintaining the barrier member in the retracted position with the sliding sleeve; and shifting the sliding sleeve in response to landing the third isolation device and thereby releasing the barrier member to transition to the extended position.

6. The method of claim 1, wherein pumping the deactivation fluid through the bypass mechanism to the shoe track is followed by:

landing a fourth isolation device within the flow path above the communication tool; and pumping a verification fluid against the fourth isolation device to verify predetermined pressure specifications.

7. The method of claim 1, further comprising:

maintaining a lower casing barrier in the shoe track in an open position until landing the first isolation device; and moving the lower casing barrier to a closed position in response to landing the first isolation device to isolate the shoe track from back pressure provided wellbore fluids.

8. The method of claim 1, wherein radially expanding the seal member comprises pumping an inflation fluid against the first isolation device.

9. The method of claim 1, wherein activating the bypass mechanism comprises pumping the deactivation fluid against the first isolation device to a predetermined pressure.

* * * * *